US007796909B2

(12) United States Patent
Nishimura

(10) Patent No.: US 7,796,909 B2
(45) Date of Patent: Sep. 14, 2010

(54) COMMUNICATION CONTROL DEVICE AND IMAGE FORMING DEVICE

(75) Inventor: Jun Nishimura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 406 days.

(21) Appl. No.: 12/069,839

(22) Filed: Feb. 13, 2008

(65) Prior Publication Data

US 2008/0197558 A1 Aug. 21, 2008

(30) Foreign Application Priority Data

Feb. 16, 2007 (JP) ..... 2007-036735

(51) Int. Cl.
*G03G 15/00* (2006.01)

(52) U.S. Cl. ..... 399/75; 399/391

(58) Field of Classification Search ..... 399/75, 399/76, 46, 391, 361
See application file for complete search history.

(56) References Cited

U.S. PATENT DOCUMENTS 7,050,751 B2 * 5/2006 Watanabe et al. ..... 399/391

FOREIGN PATENT DOCUMENTS

JP 61012546 A * 1/1986
JP 2000-351252 12/2000
JP 2004091058 A * 3/2004

* cited by examiner

*Primary Examiner*—Susan S Lee
(74) *Attorney, Agent, or Firm*—Jordan and Hamburg LLP

(57) ABSTRACT

To prevent damages to a recording paper that is being transported and a jam of the recording paper within a device caused due to shift in the timings of communications through providing a communication control device that has a main body control unit 100 connected to each paper feeding control unit 200 via common communication lines, which transmits control instructions by using a unicast mode that individually transmits control data to each of the paper feeding control units 200 from the main body control unit 100 at different timings, and transmits executing instructions for the control instructions by using a broadcast mode that transmits control data simultaneously.

8 Claims, 9 Drawing Sheets

| | Unicast mode | | | | Broadcast mode | |
|---|---|---|---|---|---|---|
| Paper feeding control unit to which control data is transmitted | First drawer 200a | Second drawer 200b | Third drawer 200c | Forth drawer 200d | All | All |
| Select signal transmitted from main-body side communication control device | 100 (A) | 110 (B) | 111 (C) | 011 (D) | 010 (F) | 101 (F) |
| Select signal received at paper feeding control unit 200a | 100 (E) | 110 | 111 | 011 | 010 | 101 |
| Select signal received at paper feeding control unit 200b | 000 | 100 (E) | 110 | 111 | 101 | 010 |
| Select signal received at paper feeding control unit 200c | 001 | 000 | 100 (E) | 110 | 010 | 101 |
| Select signal received at paper feeding control unit 200d | 011 | 001 | 000 | 100 (E) | 101 | 010 |

Fig.6

COMMUNICATION CONTROL DEVICE AND IMAGE FORMING DEVICE

BACKGROUND OF THE INVENTION

This application is based on an application No. 2007-36735 filed in Japan, the contents of which are hereby incorporated by reference.

1. Field of the Invention

The present invention relates to a communication control device for controlling communications between a main body control unit and each paper feeding control unit, wherein the main body control unit for controlling an image forming unit is connected, via communication lines, to a plurality of the paper feeding control units which control supply of recording papers to the image forming unit, respectively, by corresponding to a plurality of paper feeding cassettes. Further, the present invention relates to an image forming device in which the image forming unit and the paper feeding control unit are connected via the communication control device.

2. Description of the Related Art

An image forming device such as a digital copying machine is constituted to be able to have a plurality of option units such as a sorter and a plurality of paper feeding cassettes detachably attached to a main body of the device.

Japanese Unexamined Patent Application Publication No. 2000-351252 discloses a structure which, when mounting a plurality of option units to a printer main body, shares serial communication lines that connect a control unit of the printer main body and control units of each of the option units by cascaded connecting the serial communication lines in a cascade manner between each of the option units.

Each of the option units includes communication means that includes a first connector for transmitting and receiving signals by being connected to the printer as well as a second connector for transmitting and receiving signals to/from another option unit. The communication device is constituted to transmit a signal that is received from the printer via the first connector to another option unit via the second connector, and to transmit a signal that is received from another option unit via the second connector to the printer via the first connector.

Further, the communication means includes a return path for enabling transmission of signals to the printer via the first connector without transmitting the signals to another option unit via the second connector.

With the above-described structure, combinations and connecting orders of the option units that are connected to the serial communication lines can be set freely.

In order to achieve the same object, it is also possible to have a communication control device that employs a polling system for communicating with each paper feeding cassette by switching address data on address lines, through connecting a device main body and a plurality of paper feeding cassettes as the option units via common serial communication lines and a plurality of the address lines for selecting each paper feeding cassette.

For example, when the plurality of paper feeding cassettes are piled up in a vertical direction at a bottom part of the device main body, the serial communication lines and the address lines are connected detachably via drawer connectors that are provided to the device main body and each of the paper feeding cassettes, and communications are performed by executing polling in order from a paper feeding cassette to which the communication control device is mounted first, i.e. a paper feeding cassette that is connected on the highest drawer, towards the lower drawers one by one.

The paper feeding control unit provided to each of the paper feeding cassettes drive- or stop-controls a paper feeding roller based on a control instruction that is received via the communication control device from the main body control unit via the serial communication line, and drive- or stop-controls a transporting roller for transporting the fed recording paper to a main body side.

The transporting rollers controlled by each of the paper feeding control units are provided along a common transporting path to the main body side. Thus, the paper feeding control units on an upper drawer side (on the downstream side along the transporting path) need to drive- or stop-control the corresponding transporting rollers for transporting the recording paper that is fed by the paper feeding control unit on a lower side (on the upstream side along the transporting path) towards the main body.

However, with the above-described communication control device that employs the polling system, a necessary control instruction is transmitted to each of the paper feeding control units in order at a prescribed interval. Therefore, even when it is required to stop or drive the transporting rollers of each paper feeding cassette at once, for example, there is delay of several milliseconds in the time at which a control instruction reaches the paper feeding control units of each paper feeding cassette. As a result, synchronicity of the control cannot be secured. In the above-described case, the paper feeding control unit mounted to the paper feeding cassette of the highest drawer is to receive the control instruction at the earliest time, and the paper feeding control unit mounted to the paper feeding cassette of the lowest drawer is to receive the control instruction at the latest time.

The paper feeding control unit of a lower drawer that receives a control instruction for stopping the transporting roller later than that of a upper drawer exhibits delay in the timing for stopping the transporting roller for an amount of delay time in receiving an instruction with respect to that of the transporting roller of the upper drawer. Therefore, the recording paper becomes bent between the transporting rollers located on the upper drawer and on the lower drawer.

Similarly, the paper feeding control unit in the lower drawer that receives the control instruction for driving the transporting roller later than that of the upper drawer exhibits delay in the timing for driving the transporting roller for an amount of delay time in receiving the instruction with respect to that of the transporting roller of the upper drawer. Therefore, there is a tension supplied to the recording paper between the transporting rollers located on the upper drawer and on the lower drawer.

This results in causing such problems that the recording paper may be fed obliquely to the transporting path, the recording paper may be jammed, or the recording paper may be damaged.

SUMMARY OF THE INVENTION

In view of the foregoing issues, it is an object of the present invention to prevent damages to the recording papers that are being transported, and to prevent paper jams, etc., which are caused due to shift in the communication timings.

The communication control device according to the present invention is a communication control device for controlling communications between a main body control unit and each of a plurality of paper feeding control units by having the main body control unit for controlling an image forming unit connected, via common communication lines, to the plurality of paper feeding control units for individually controlling a plurality of paper feeding cassettes that supply recording papers to the image forming unit. The communication control device includes: a unicast mode for transmitting control data individually from the main body control unit to each of the paper feeding control units at different timings; a broadcast mode for transmitting control data from the main body control unit to each of the paper feeding control units simultaneously; and a communication mode switching part for switching communication modes between the unicast mode and the broadcast mode.

It is preferable for the communication mode switching part to switch the communication mode from the unicast mode to the broadcast mode at least when stopping the recording paper that is being transported on a paper feeding path from the paper feeding cassette to the image forming unit, or when restarting transportation of the recording paper that is being stopped on the paper feeding path.

Further, it is preferable to transmit a control instruction to each of the paper feeding control units with the unicast mode, and to transmit an executing instruction for the control instruction with the broadcast mode.

Further, other aspects of the present invention will become clear by referring to embodiments provided hereinafter.

BRIEF DESCRIPTION OF THE DRAWINGS

FIG. 6 is an illustration for describing codes of select signals that are transmitted from a main body control unit side and received on a paper feeding control unit side;

DESCRIPTION OF THE PREFERRED EMBODIMENTS

Hereinafter, described is an embodiment in which a communication control device according to the present invention is applied to a tandem-system color digital copying machine that is an example of an image forming device.

Figure 2:
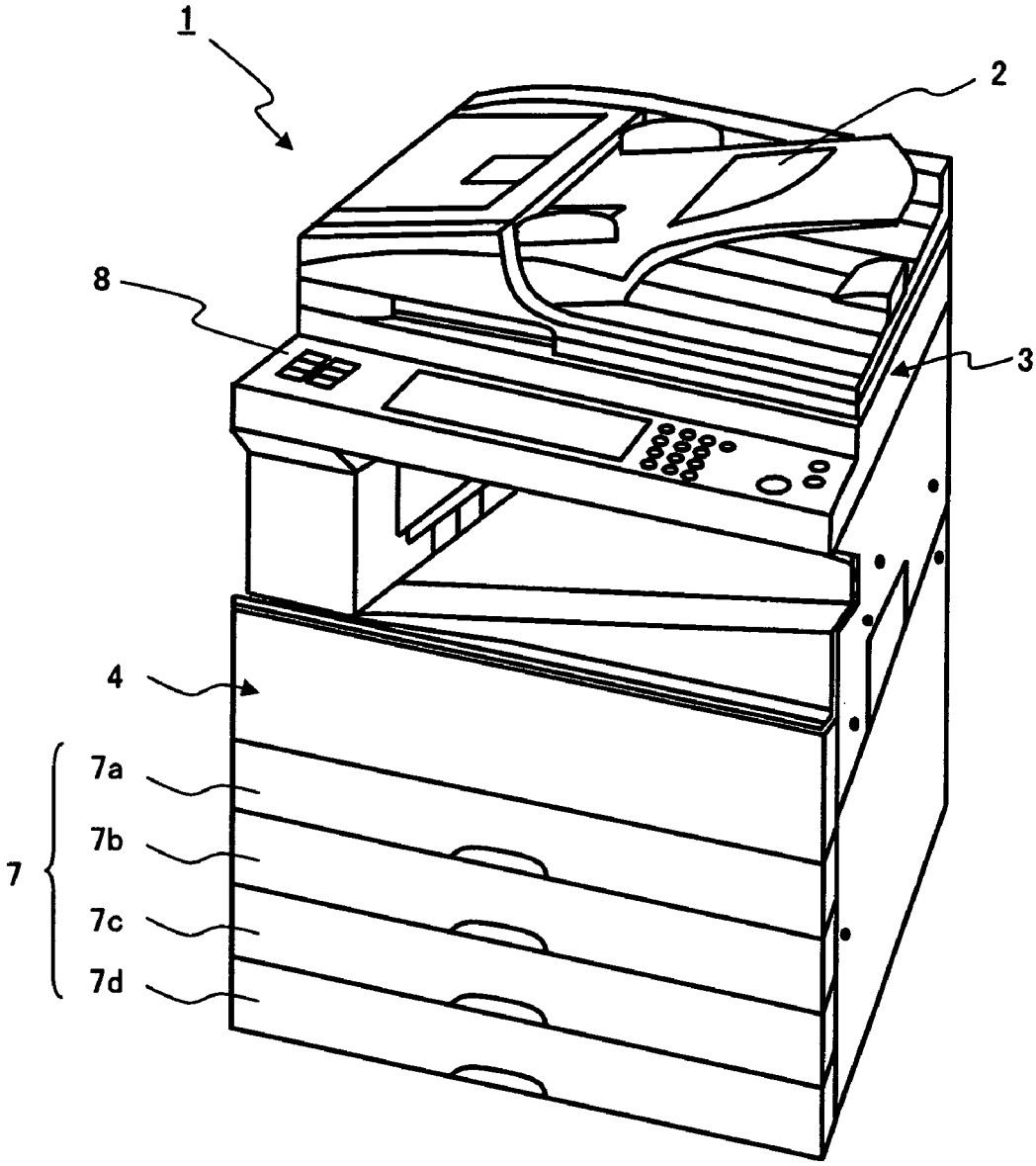
FIG. 2 is a general view of the color digital copying machine.

As shown in FIGS. 2 and 3, a color digital copying machine 1 is constituted with a main body unit having a plurality of functional blocks, and paper feeding units. The main body unit includes: an operation part 8 where a plurality of menu setting keys and the like for setting various kinds of menus are arranged; a manuscript loading part 2 on which a manuscript is set; an image readout part 3 which reads out an image from a manuscript and converts it to electronic data; an image forming unit 4 which forms a toner image on a recording paper based on image data that is converted to electronic data by the image readout part 3, and outputs the formed toner image; a fixing part 5 for fixing the toner image formed on the recording paper onto the recording paper by applying heat; a transporting part 6 for transporting the recording paper; and the like.

In the paper feeding unit provided beneath the image forming unit 4, a plurality of paper feeding cassettes 7 (7*a*-7*d*) having recording papers of different sizes and kinds from each other housed therein are provided by piled up in a height direction.

Each of the paper feeding cassettes 7 includes a respective paper feeding roller 71 (71*a*-71*d*) for supplying the housed recording papers to the device main body, and a respective transporting roller 72 (72*a*-72*d*) arranged along a common transporting path to a device main body side for transporting the fed recording papers towards the device main body.

Figure 3A:
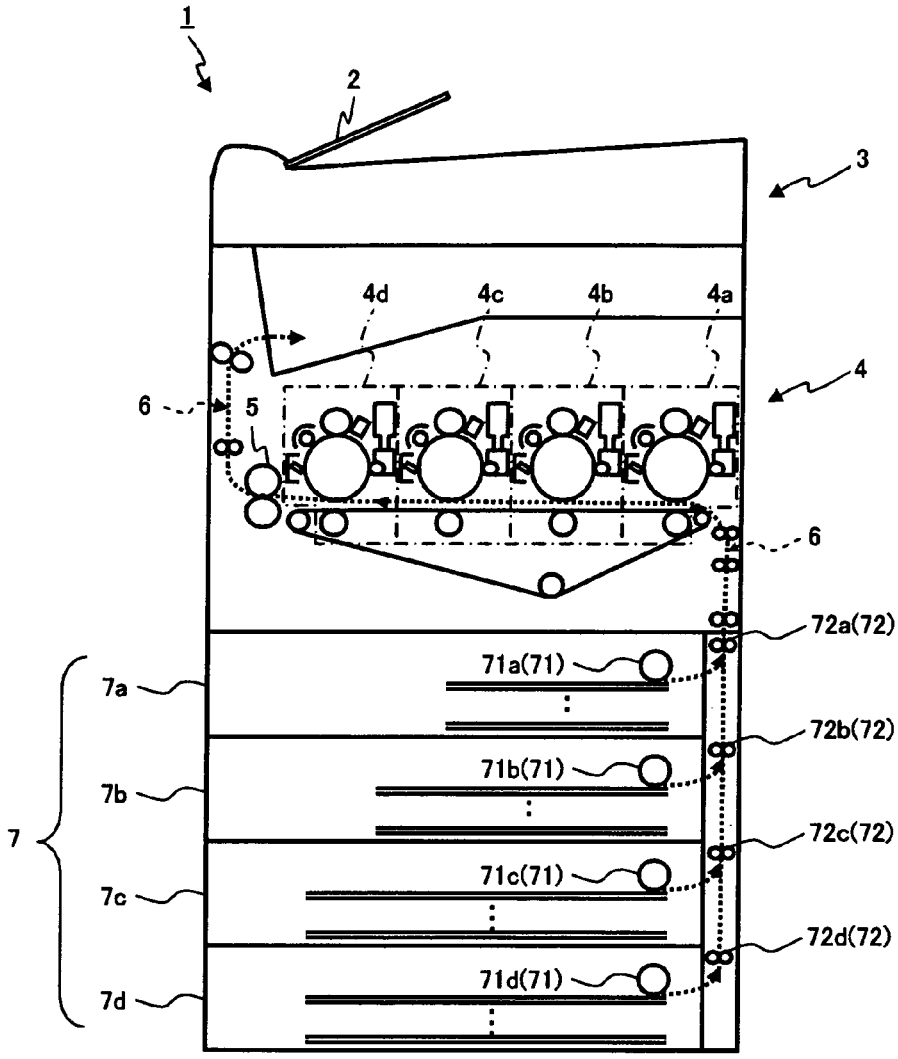
FIG. 3A is an illustration for describing a schematic structure of the color digital copying machine.

As shown in FIG. 3A, in the image forming unit 4, four kinds of image forming parts 4*a*-4*d* each having a developing part that corresponds to toner colors of Y (yellow), M (magenta), C (cyan), and K (black) are arranged in parallel on a transporting belt.

Figure 3B:
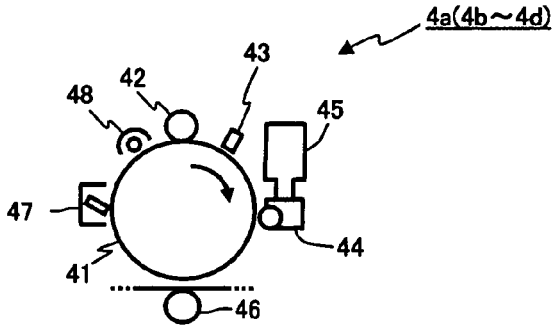
FIG. 3B is an illustration for describing a schematic structure of an image forming part.

Then, as shown in FIG. 3B, each of the image forming parts 4*a*-4*d* includes: an image carrier 41; and a charging member 42, a print head 43, a developing part 44, a transferring part 46, a cleaner part 47, and an eraser lamp 48, which are arranged in order around the image carrier 41. A toner cartridge 45 as an exchange unit is connected to the developing part 44, so that new toner can be supplied from the toner cartridge to the developing part 44.

The image carrier 41 is charged with the charging member 42 that is arranged to be in contact with the image carrier 41. The charged image carrier 41 is exposed by the print head 43 to form an electrostatic latent image, and toner is developed by the developing part 44 on the electrostatic latent image formed in the image carrier 41 to form a toner image. The developed image is transferred by the transferring part 46 to the recording paper that is transported by the transporting belt.

In the cleaner part 47, the toner remained in the image carrier 41 after the transfer is removed and collected, and a residual charge on a surface of the image carrier 41 is removed by the eraser lamp 48.

Figure 1:
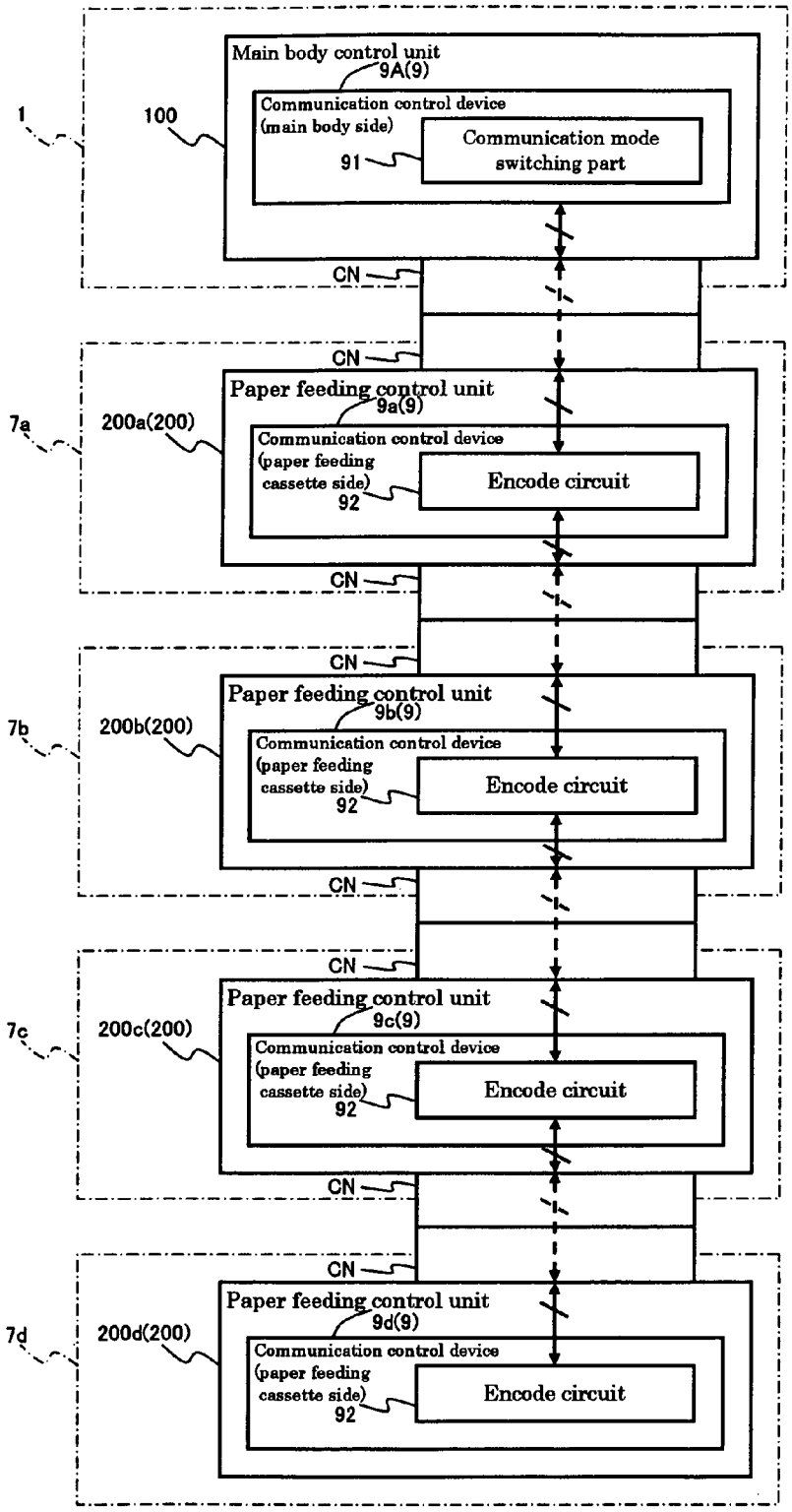
FIG. 1 shows a functional block diagram of a main unit of a color digital copying machine that includes a communication control device and control units that are disposed in each paper feeding unit.

A plurality of control units for controlling each of the above-described functional blocks are provided to the color digital copying machine 1. Specifically, as shown in FIG. 1, provided are: a main body control unit 100 for controlling the image readout part 3, the image forming unit 4, the fixing part 5, and the transporting part 6; and a plurality of paper feeding control units 200 for individually controlling the plurality of paper feeding cassettes 7 that supply the recording papers to the image forming unit 4. The main body control unit 100 is mounted to the main body unit, and the paper feeding control units 200 are mounted to the respective paper feeding cassettes 7*a*-7*d*.

That is, as the paper feeding control units 200, a paper feeding control unit 200*a* for controlling the paper feeding cassette 7*a* on a first drawer, a paper feeding control unit 200*b* for controlling the paper feeding cassette 7*b* on a second drawer, a paper feeding control unit 200*c* for controlling the paper feeding cassette 7*c* on a third drawer, and a paper feeding control unit 200*d* for controlling the paper feeding cassette 7*d* on a fourth drawer are provided to the respective paper feeding cassettes 7*a*-7*d*.

Each of the paper feeding control units 200 drive-controls the paper feeding roller and the transporting roller for supplying the recording papers housed in the own paper feeding cassette 7 to the device main body. Further, the respective paper feeding control units 200 on an upper drawer side drive-control the transporting roller to transport the recording papers that are fed by the paper feeding control unit 200 on the lower drawer side to a main body side.

The main body control unit 100 and the paper feeding control units 200 each include: a single or a plurality of CPU(s) on a single or a plurality of control board(s); a ROM to which a control program and the like to be executed by the CPU are stored; a RAM functioning as a working area of the CPU, which stores control data and the like; an input/output interface circuit which outputs signals to loads such as a motor and a clutch of each functional block as the control targets, and inputs detected values from various sensors and the like; and so on.

In the color digital copying machine 1, each of prescribed functions is achieved by the control programs executed by each CPU and by related hardware, and image forming processing is executed when each functional block operates together as a whole.

As shown in FIG. 1, a signal line is connected between the main body unit and the paper feeding cassettes from the cassette 7*a* of the highest drawer to the cassette 7*d* of the lowest drawer via respectively provided drawer connectors CN.

The main body control unit 100 and the plurality of paper feeding control units 200 are connected with common communication lines via the drawer connectors CN described above, and there are provided communication control devices 9 for controlling communications between the main body control unit 100 and each of the paper feeding control units 200 with a polling system.

The communication control devices 9 are constituted with a main-body side communication control device 9A provided to the main body control unit 100, and paper-feeding side communication control devices 9*a*-9*d* provided to respective paper feeding control units 200*a*-200*d*. The main control unit 100 and the paper feeding control units 200*a*-200*d* exchange control data via the main-body side communication control device 9A and the paper-feeding side communication control devices 9*a*-9*d*, respectively.

The communication lines are constituted with: bidirectional serial communication lines for transmitting and receiving the control data between each of the control units; a clock signal line for transmitting clock signals from the main body control unit 100 to the paper feeding control units 200 for synchronizing transmission/reception data on the serial communication line; three select signal lines for designating the paper feeding control unit 200 that transmits/receives control data to/from the main body control unit 100; and a ready signal line for informing that the paper feeding control unit 200 is ready to transmit/receive data to/from the main body control unit 100.

The main-body side communication control device 9A communicates with the paper-feeding side communication control devices 9*a*-9*d* by employing the polling system. That is, the main-body side communication control device 9A outputs each select signal to the paper-feeding side communication control devices 9*a*-9*d* by switching it in a prescribed order at a prescribed interval, and handshakes with the paper-feeding side communication control device that is selected by the select signal to perform communication therebetween. Procedures of such communication will be described later by referring to FIG. 4.

The main-body side communication control device 9A includes a communication mode switching part 91 which switches two kinds of modes; one of which is a unicast mode for transmitting/receiving the control data individually between the main body control unit 100 and each of the paper feeding control units 200 at different timings, and the other is a broadcast mode for transmitting the control data from the main body control unit 100 to each of the paper feeding control units 200 simultaneously.

Figure 5:
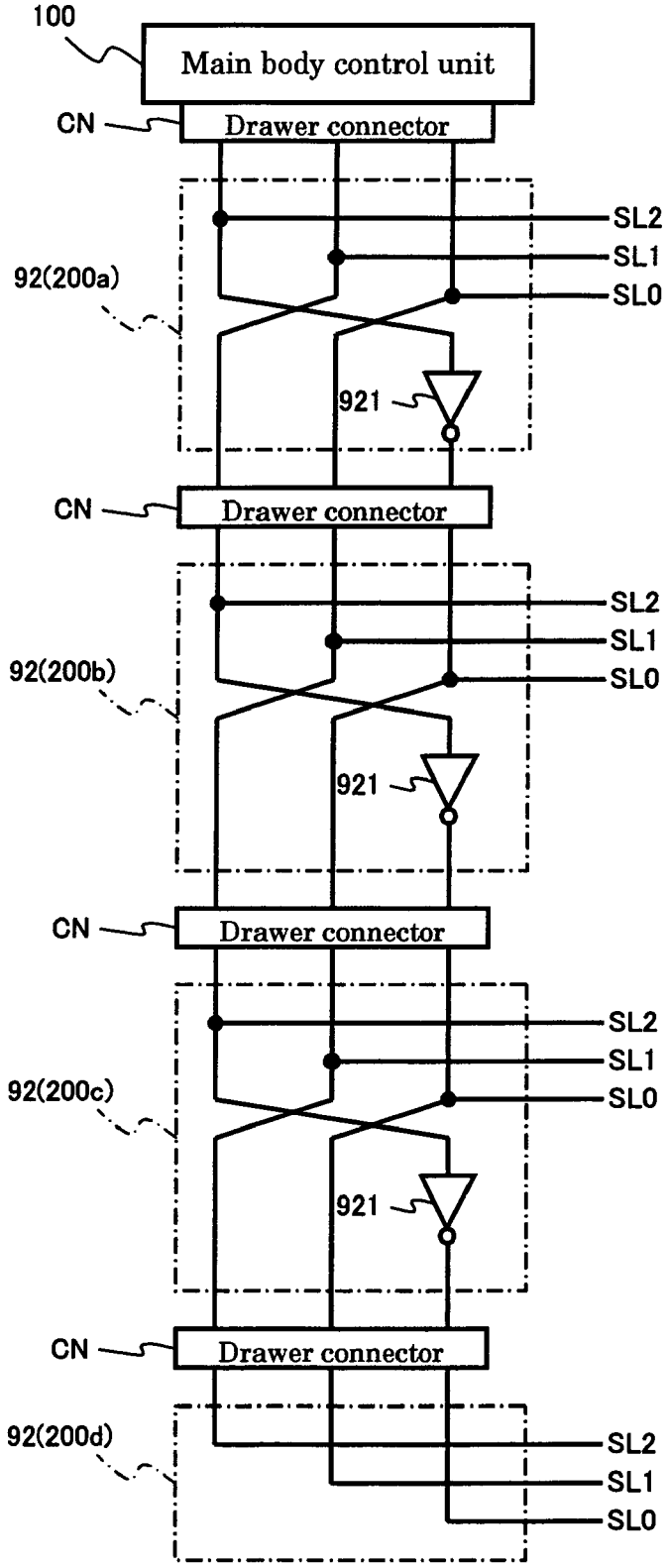
FIG. 5 is an illustration for describing an encode circuit.

As shown in FIGS. 1 and 5, the three select signal lines extended out from the main-body side communication control device 9A are connected, through the paper-feeding side communication control devices 9*a*, 9*b*, and 9*c*, to the paper-feeding side communication control devices 9*b*, 9*c*, and 9*d*.

Each of the paper-feeding side communication control devices 9*a*, 9*b*, 9*c* includes an encode circuit 92 which inverts one of the three select signal lines and translates it to the paper-feeding side communication control devices 9*b*, 9*c*, 9*d* of the lower drawers.

Each of the encode circuits 92 is constituted with three select signal lines SL0, SL1, SL2 and an inverter circuit 921 that inverts the logic of select signals transmitted via one of the select signal lines. The encode circuit 92, before outputting the inputted select signal to the encode circuit 92 of the lower drawer, switches the select signal line SL2 to the select signal line SL0, the select signal line SL1 to the select signal line SL2, and the select signal line SL0 to the select signal line SL1, and inverts the logic of the select signal that is transmitted via the switched select signal line SL0 with the inverter circuit 921.

As shown in FIG. 6, if the main-body side communication control device 9A transmits a select signal of "100 (SL2=1, SL1=0, SL0=0) ("A" in the drawing) when sending the control data by handshaking with the paper feeding control unit 200*a* of the first drawer (the highest drawer), the select signal "100" is received at the paper feeding control unit 200*a* of the first drawer (the highest drawer).

Further, if the main-body side communication control device 9A transmits a select signal of "110" ("B" in the drawing) when sending the control data by handshaking with the paper feeding control unit 200*b* of the second drawer, the select signal "100" is received at the paper feeding control unit 200*b* of the second drawer.

Similarly, if the main-body side communication control device 9A transmits a select signal of "111" ("C" in the drawing) when sending the control data by handshaking with a paper feeding control unit 200*c* of a third drawer, the select signal "100" is received at the paper feeding control unit 200*c* of the third drawer. If the main-body side communication control device 9A transmits a select signal of "011" ("D" in the drawing) when sending the control data by handshaking with the paper feeding control unit 200*d* of a fourth drawer (the lowest drawer), the select signal "100" is received at the paper feeding control unit 200*d* of the fourth drawer.

When the select signal "100" is inputted to one of the paper feeding control units 200 ("E" in the drawing), select signals other than "100" are inputted to the other paper feeding control units 200. Thus, when each of the paper feeding control units 200 receives the select signal "100", the paper feeding control unit 200 recognizes that it is selected.

It is unnecessary for each of the paper feeding control units 200 to recognize in advance which drawer of the paper feeding cassette it belongs to. It can be recognized based on structural data of the paper feeding cassette that is contained in communication data transmitted from the main-body side communication control device 9A via the serial communication line after receiving the select signal "100".

When there is a response from the paper-feeding side communication control device for the select signal outputted from the main-body side communication control device 9A, the main body control unit 100 recognizes that the paper feeding control unit 200 to which the paper-feeding side communication control device is mounted is loaded, and transmits the structural data of the paper feeding cassette to the paper feeding control unit 200, indicating which drawer of the paper feeding cassette it belongs to.

Therefore, any of the paper feeding control units 200 can be shared by any of the paper feeding drawers without customizing the mechanisms of each paper feeding cassette and the programs stored in the ROMs of each of the paper feeding control units 200.

With the unicast mode, the main-body side communication control device 9A outputs the select signals "100", "110", "111", "011" by switching those in this order at a prescribed time interval, and handshakes with each of the paper-feeding side communication control devices 9*a*-9*d* via the serial communication lines to transmit/receive the control data.

Figure 7:
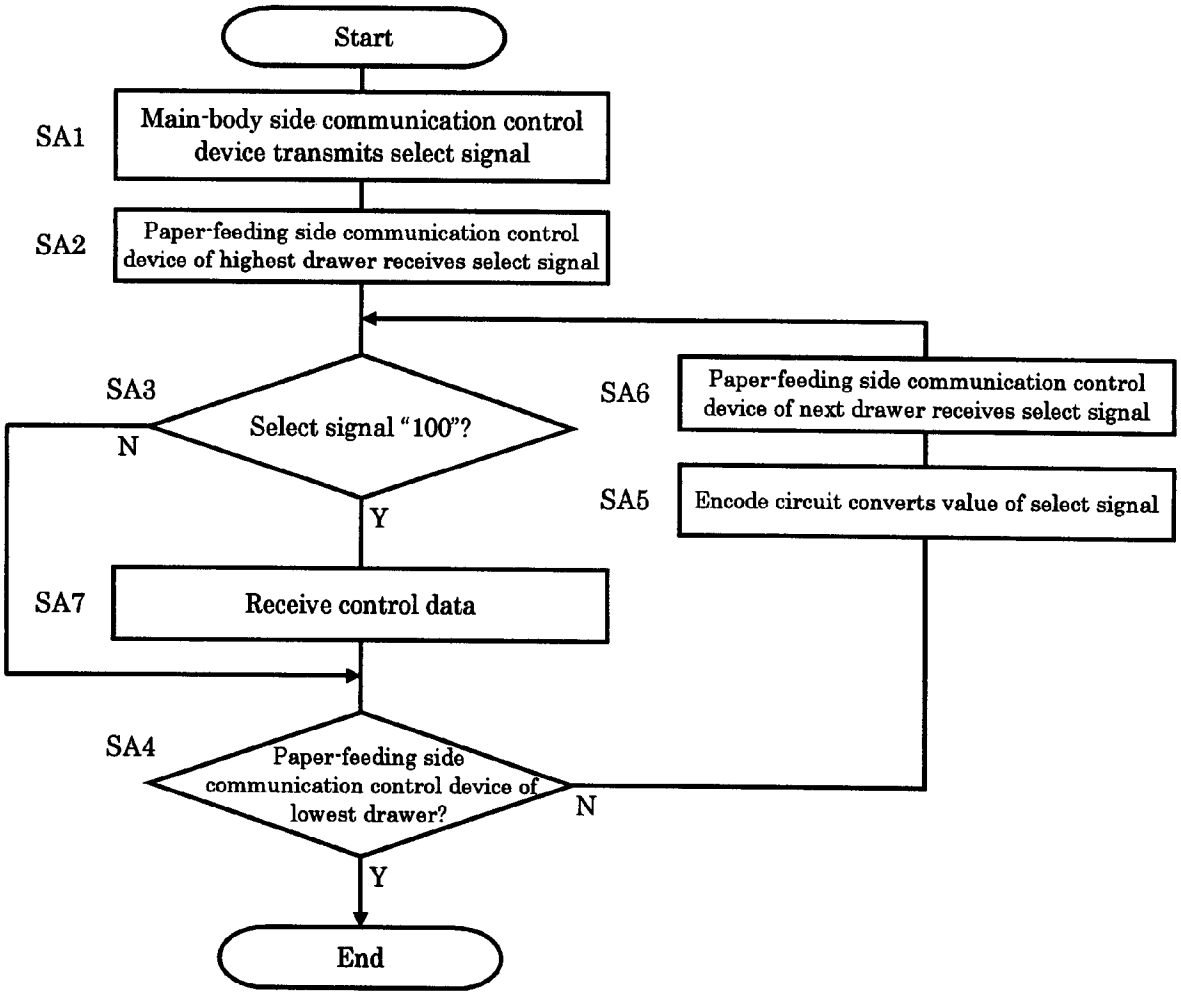
FIG. 7 is a flowchart for describing processing performed on the select signal and control data transmitted with a unicast mode.

By referring to a case where four drawers of the paper feeding cassettes 7*a*-7*d* are loaded to the color digital copying machine 1, there is described receiving processing of the paper-feeding side communication control devices 9*a*-9*d* when the control data is transmitted from the main-body side communication control device 9A with the unicast mode, based on a flowchart shown in FIG. 7.

When the main-body side communication control device 9A transmits the select signal "111" to the paper feeding control unit 200*c* on the third drawer (SA1), the paper-feeding side communication control device 9*a* on the highest drawer judges that the received select signal is not the select signal "100" for itself (SA2, SA3). Thus, the paper-feeding side communication control device 9*a* does not execute the control data receiving processing.

Before the select signal reaches the paper-feeding side communication control device 9*d* on the lowest drawer (SA4), the select signal is converted from "111" to "110" by the encode circuit 92 that is mounted to the paper-feeding side communication control device 9*a* on the highest drawer (SA5). The paper-feeding side communication control device 9*b* on the second drawer upon receiving the converted select signal also judges that the received select signal is not the select signal "100" for itself (SA6, SA3). Thus, the paper-feeding side communication control device 9*b* does not execute the control data receiving processing.

Before the select signal reaches the paper-feeding side communication control device 9*d* on the lowest drawer (SA4), the select signal is converted from "110" to "100" by the encode circuit 92 that is mounted to the paper-feeding side communication control device 9*b* on the second drawer (SA5). The paper-feeding side communication control device 9*c* on the third drawer upon receiving the converted select signal judges that the received select signal is the select signal "100" for itself (SA6, SA3). Thus, the paper-feeding side communication control device 9*c* executes the control data receiving processing and stores the received control data (SA7).

Before the select signal reaches the paper-feeding side communication control device 9*d* on the lowest drawer (SA4), the select signal is converted from "100" to "000" by the encode circuit 92 that is mounted to the paper-feeding side communication control device 9*c* on the third drawer (SA5). The paper-feeding side communication control device 9*d* on the lowest drawer upon receiving the converted select signal also judges that the received select signal is not the select signal "100" for itself (SA6, SA3). Thus, the paper-feeding side communication control device 9*d* does not execute the control data receiving processing.

That is, when the select signal for the paper feeding control unit 200*c* on the third drawer outputted from the main-body side communication control device 9A is converted in order by the encode circuits 92 of each paper feeding drawer and received at the paper-feeding side communication control device 9*d* of the lowest drawer (SA4), it is switched by the main-body side communication control device 9A to a select signal for the paper feeding control unit 200*c* of the next paper feeding drawer. Then, the same operations are repeated.

In the meantime, when the select signal "010" or "101" is outputted from the main-body side communication control device 9A ("F" in FIG. 6), the select signal "010" or "101" is received at each of the paper feeding control units 200 via the encode circuits 92.

With the broadcast mode, by corresponding to the select signal "010" or "101" that is outputted from the main-body side communication control device 9A, all the paper-feeding side communication control devices 9*a*-9*d*, which recognize the select signal as "010" or "101", receive the control data via the serial communication lines.

That is, the encode circuits 92 convert the individual select signals outputted from the main-body side communication control device 9A into a common select signal with the unicast mode, while converting the individual select signals outputted from the main-body side communication control device 9A into specific signals other than the common select signal with the broadcast mode.

Figure 8:
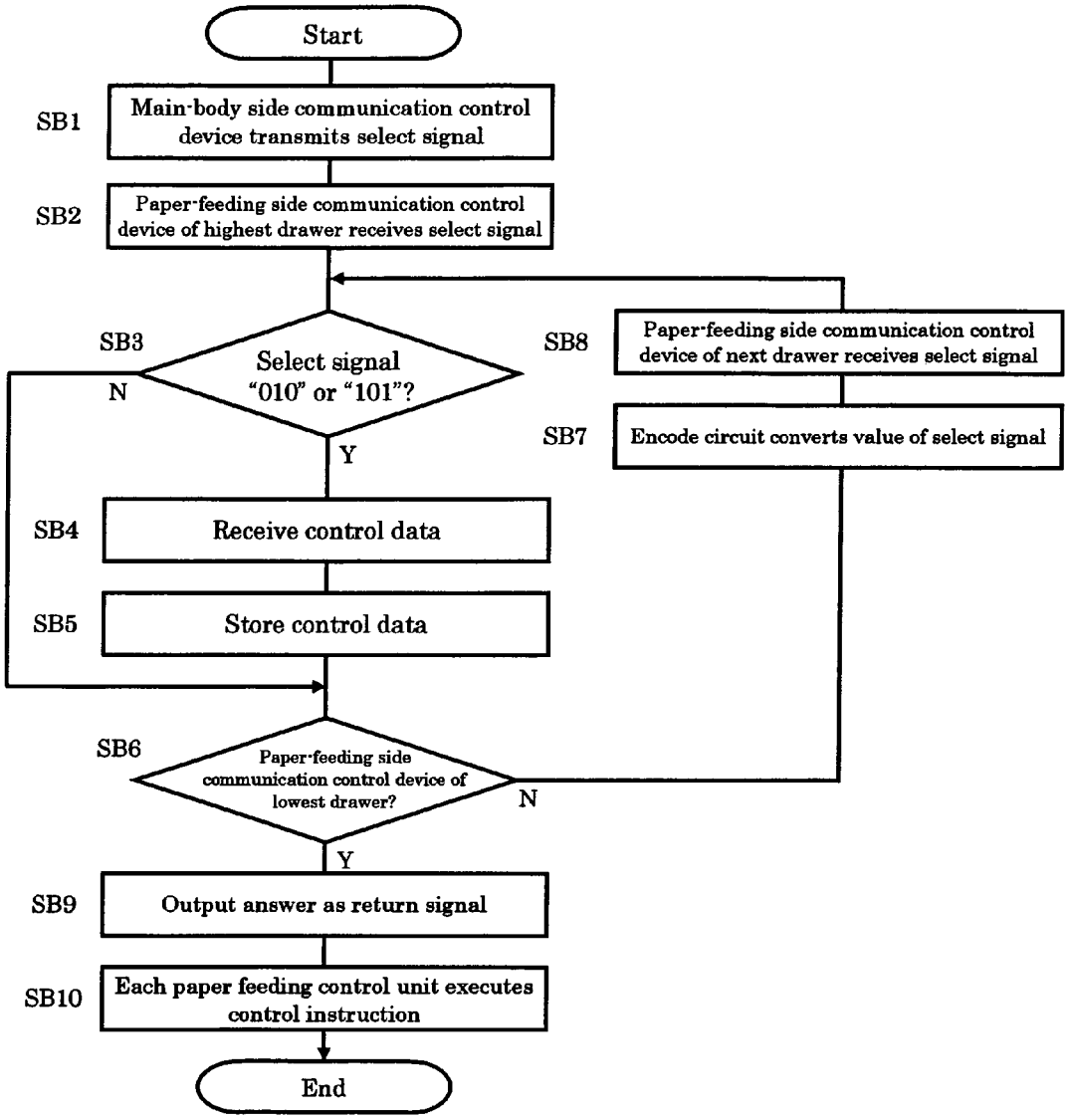
FIG. 8 is a flowchart for describing processing performed on the select signal and the control data transmitted with a broadcast mode.

By referring to a case where four drawers of the paper feeding cassettes 7*a*-7*d* are loaded to the color digital copying machine 1, there is described receiving processing of the paper-feeding side communication control devices 9 when the control data containing an execution instruction is transmitted from the main-body side communication control device 9A with the broadcast mode, based on a flowchart shown in FIG. 8.

When the main-body side communication control device 9A transmits the select signal "101" (SB1), the paper-feeding side communication control device 9*a* on the highest drawer judges that the received select signal is of the broadcast mode (SB2, SB3). Thus, the paper-feeding side communication control device 9*a* executes the control data receiving processing and stores the received control data (SB4, SB5).

Before the select signal reaches the paper-feeding side communication control device 9*d* on the lowest drawer (SB6), the select signal is converted from "101" to "010" by the encode circuit 92 that is mounted to the paper-feeding side communication control device 9*a* on the highest drawer (SB7). The paper-feeding side communication control device 9*b* on the second drawer upon receiving the converted select signal also judges that the received select signal is of the broadcast mode (SA8, SB3). Thus, the paper-feeding side communication control device 9*b* executes the control data receiving processing and stores the received control data (SB4, SB5).

When the same processing is repeated and the select signal reaches the paper-feeding side communication control device 9*d* on the lowest drawer (SB6), the paper-feeding side communication control device 9*d* on the lowest drawer outputs an answer signal to the main-body side communication control device 9A via the serial communication line (SB9).

When each of the paper-feeding side communication control devices 9 receives the control data, each of the paper feeding control units 200*a*-200*d* executes corresponding controls all at once (SB10).

Operations of the color digital copying machine 1 will be described hereinafter.

When the color digital copying machine 1 is started up, it is set by the communication switching part 91 to be in the unicast mode. At the time of startup, the main-body side communication control device 9A outputs the select signals in the above-described order. The main-body side communication control device 9A recognizes the paper feeding control unit 200, which is confirmed to have responded by corresponding to each select signal, as being loaded to the device main body, while recognizing the paper feeding control unit 200, which is not confirmed to have responded by corresponding to each select signal, as not being loaded to the device main body or as having a fault.

Next, when the main-body side communication control device 9A transmits, to the paper feeding control unit 200 that is confirmed to be loaded to the device main body, the structural data of the paper feeding cassette indicating which drawer of the paper feeding cassette it belongs to, the paper feeding control unit 200 that has received the structural data of the paper feeding cassette recognizes which drawer of the paper feeding cassette it belongs to.

When an image forming operation is started, the main-body side communication control device 9A outputs, to the corresponding paper feeding control unit 200, a paper feeding instruction for driving the paper feeding roller and a transporting instruction for driving the transporting roller. The paper feeding control unit 200 upon receiving the paper feeding drive instruction and the transporting drive instruction drive-controls the paper feeding roller and the transporting roller.

Figure 4:
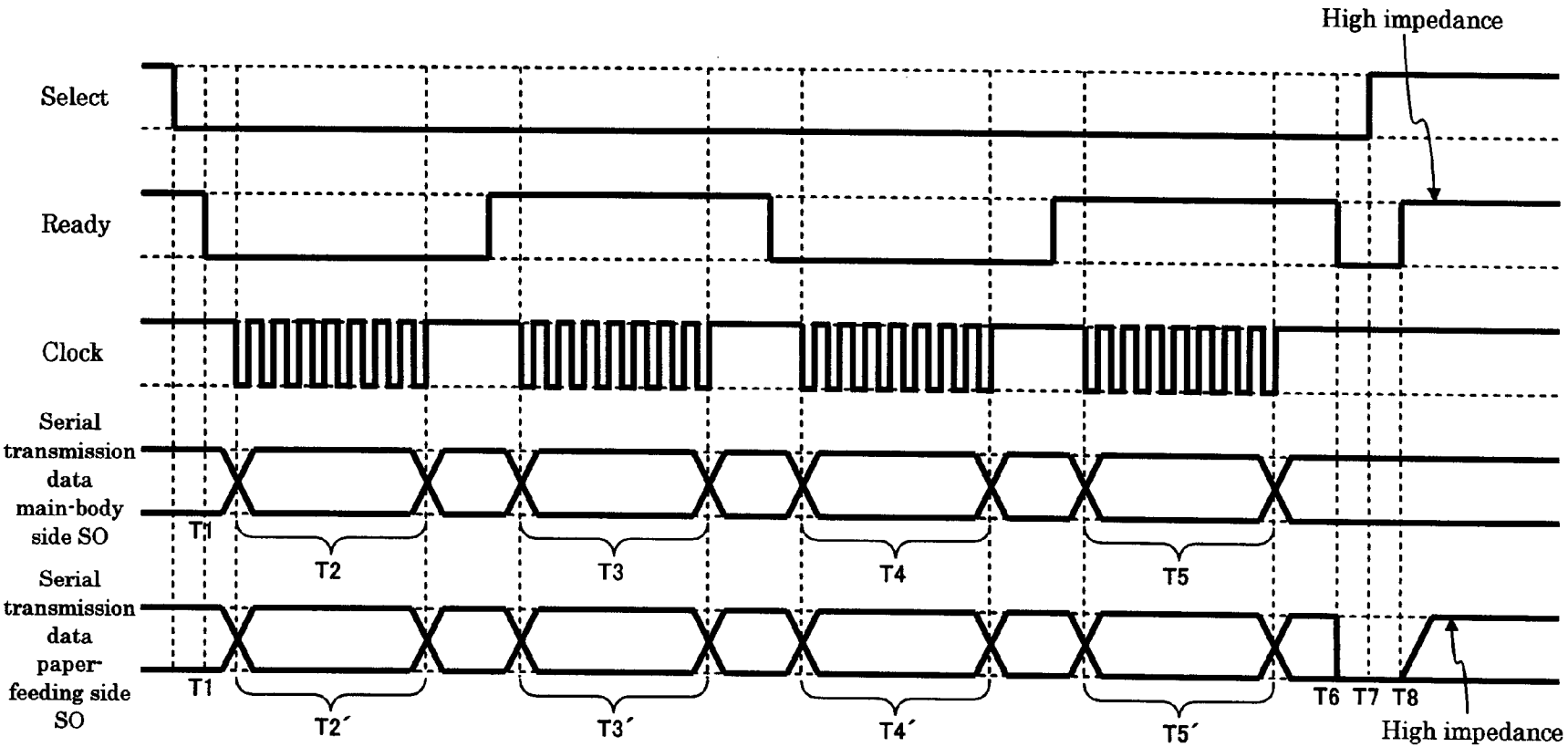
FIG. 4 is a time chart for describing a transmitting sequence of data that is transmitted via communication lines.

The procedure for transmitting/receiving the control data via the communication line connected between the main body control unit 100 and the paper feeding control unit 200*b* of the second drawer, i.e. a handshake sequence, will be described based on a time chart shown in FIG. 4.

When recognizing that the select signal outputted from the main-body side communication control device 9A is the select signal for the paper-feeding side communication control device 9*b* itself (in the drawing, the select signal is schematically illustrated as a single signal, and illustrated to become low level (active level) when it is the select signal for the device itself), the paper-feeding side communication control device 9*b* outputs a low-level ready signal to the main-body side communication control device 9A to notify that it is ready to receive data (T1).

Upon confirming that the ready signal is changed to a low level, the main-body side communication control device 9A outputs the control data to the serial communication line by synchronizing with a clock signal to transmit it to the paper-feeding side communication control device 9*b* (T2).

When receiving the control data of a prescribed byte number (for example, 1 byte in FIG. 4), the paper-feeding side communication control device 9*b* inverts the ready signal to high level. Upon confirming the inversion of the ready signal, main-body side communication control device 9A outputs the clock signal again and outputs the same control data as that of the previous time to the serial communication line (T3).

The main-body side communication control device 9A transmits the same control data for a total of four times through the above-described sequence by the bidirectional serial communication line in a given direction (T2-T5). While the main-body side communication control device 9A is transmitting the control data, the paper-feeding side communication control device 9*b* transmits, to the main-body side communication control device 9A, an answer signal and control data such as size data of the recording paper and data indicating presence of the recording paper via the bidirectional serial communication line in the other direction for a total of four times in the same manner (T2'-T5').

After receiving the fourth control data, the paper-feeding side communication control device 9*b* collates the received data to confirm whether or not the reception is completed properly. The paper-feeding side communication control device 9*b* switches the serial communication line on an output side to low level when confirmed that it is received properly, and switches the serial communication line to a high level when confirmed that it is received improperly so as to notify the reception result of the control data to the main-body side communication control device 9A (T6). FIG. 4 shows a case where the data reception is completed properly.

When judged that the control data is received properly at the paper-feeding side communication control device 9*b*, the main-body side communication control device 9A switches the select signal to a value that does not correspond to any of the paper-feeding side communication control devices (in the drawing, it is shown with high level) (T7). When confirming that the select signal is switched, the paper-feeding side communication control device 9*b* switches the output serial communication line and the ready signal to high impedance (T8).

Upon confirming that the serial communication line and the ready signal are in a high impedance state, the main-body side communication control device 9A starts the next transmission, i.e. outputs the select signal that corresponds to the paper-feeding side communication control device 9*c* of the paper feeding cassette on the third drawer.

The paper feeding control unit 200 b of the paper feeding cassette 7*b* on the second drawer drives the transporting controller when a transporting drive instruction is contained in the control data received at the paper-feeding side communication control device 9*b*, for example, and stops the transporting roller when a transporting stop instruction is contained.

The main-body side communication control device 9A communicates with the paper-feeding side communication control device 9*c* on the third drawer in the same manner.

Therefore, when a transporting drive instruction is outputted to a plurality of paper feeding control units 200 by using the unicast mode, there is delay generated in the timings of the transporting drive instruction received at each of the paper feeding control units 200. Thus, there is delay generated in the drive timings of the transporting rollers controlled by each of the paper feeding control units 200 accordingly. With this, when a transporting stop instruction is outputted to the plurality of paper feeding control units 200, there is delay generated in the timings of a release stop instruction received at each of the paper feeding control units 200. As a result, there is also delay generated in each of the timings of stopping the transporting rollers controlled by each of the paper feeding control units 200.

Next, described is a case where the mode is set to the broadcast mode by the communication mode switching part 91.

When the main-body side communication control device 9A outputs the select signal "010" or "101", each of the paper-feeding side communication control devices 9*a*-9*d* recognizes that the data is transmitted with the broadcast mode, and receives the data containing a control instruction that is transmitted from the main-body side communication control device 9A via the serial communication lines.

The procedure for transmission/reception in this state is almost the same as the case of the unicast mode described above. However, it is different from the case of the unicast mode in respect that the ready signal and the serial communication line controlled for handshaking are controlled only by the paper-feeding side communication control device 9*d* on the lowest drawer, and that the control data, i.e. the answer data for the control instruction in this case, is returned to the main-body side communication control device 9A via the serial communication line only by the paper-feeding side communication control device 9*d* on the lowest drawer.

The control instruction transmitted to each of the paper-feeding side communication control devices 9*a*-9*d* from the main-body side communication control device 9A with the broadcast mode is received at each of the paper-feeding side communication control devices 9*a*-9*d* simultaneously. Therefore, there is no delay generated in the timings of executing controls that correspond to the control instructions in each of the paper-feeding side communication control devices 9*a*-9*d*, which may be generated due to delay in the timings of receiving the instruction otherwise.

When it is necessary to transmit the control instruction simultaneously to all the paper feeding control units 200*a*-200*d* which are loaded to the main body control unit 100, the communication mode switching part 91 switches the mode from the unicast mode to the broadcast mode.

For dealing with a case where there is an influence imposed upon other paper feeding cassettes 7 when a given paper feeding cassette 7 operates, e.g. in a case where a large tension is applied on the recording paper on the transporting path because the transporting roller 72*a* of the paper feeding cassette 7*a* on the top drawer drives first when the transporting roller 71*b* of the paper feeding cassette 7*b* on the lower drawer is being stopped, or in the case where the recording paper is largely bent on the transporting path because the transporting roller 72*b* of the paper feeding cassette 7*b* on the lower drawer stops with delay when the transporting roller 71*a* of the paper feeding cassette 7*a* on the top drawer stops, the control instruction necessary to be executed simultaneously by each of the paper feeding control units 200*a*-200*d* is stored in the ROM of the main body control unit 100 in advance.

When it is necessary to output such control instructions, the main body control unit 100 controls the communication mode switching part 91 provided to the main-body side communication control device 9A to switch the mode from the unicast mode to the broadcast mode.

In such case, the control instruction is transmitted to each of the paper-feeding side communication control devices 9*a*-9*d* in advance with the unicast mode. Then, an executing instruction of the control instruction transmitted that is earlier is transmitted by switching the mode to the broadcast mode.

Figure 9:
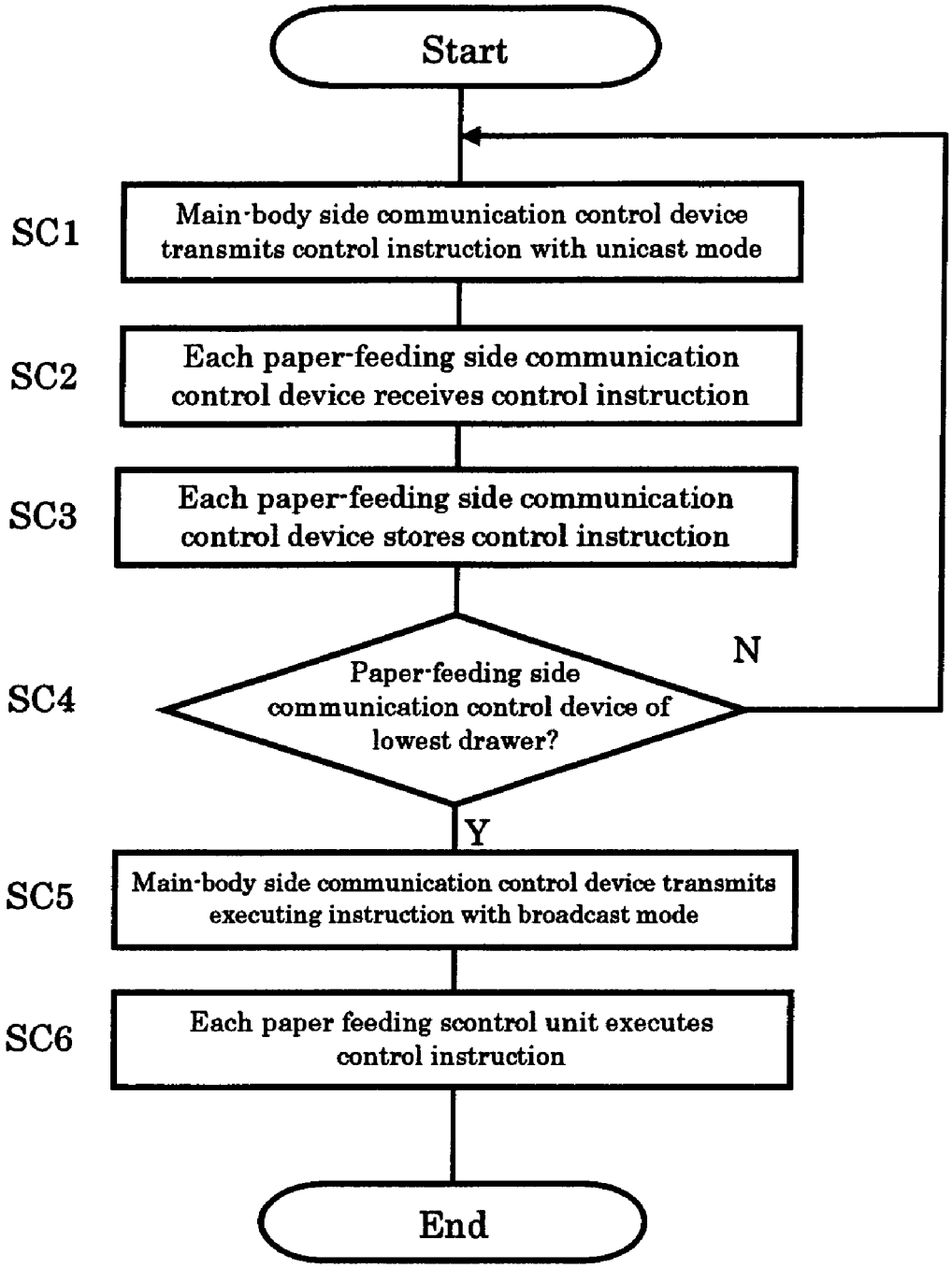
FIG. 9 is a flowchart of a paper feeding control.

The procedure thereof will be described hereinafter based on a flowchart shown in FIG. 9.

The main-body side communication control device 9A transmits a control instruction, e.g. an instruction for stopping the transporting roller, to each of the paper-feeding side communication control devices 9*a*-9*d* with the unicast mode (SC1).

Each of the paper-feeding side communication control devices 9*a*-9*d* receives the control instruction in order (SC2). Each of the paper feeding control units 200*a*-200*d* stores the control instruction to the RAM without executing the corresponding control instruction (SC3).

Upon confirming that the control instruction is transmitted to all the paper-feeding side communication control devices 9*a*-9*d* (SC4), the main-body side communication control device 9A then transmits an executing instruction, i.e. an instruction for executing the instruction for stopping the transporting roller in this case, to each of the paper-feeding side communication control devices 9*a*-9*d* simultaneously with the broadcast mode (SC5).

Upon receiving the executing instruction at each of the paper-feeding side communication control devices 9*a*-9*d*, each of the paper feeding control units 200*a*-200*d* executes the control instructions stored in the RAMs (SC6). Therefore, the control instructions can be executed simultaneously at each of the paper feeding control units 200.

The control instructions transmitted in step SC1 may not necessarily be the same control instructions for each of the paper-feeding side communication control devices 9*a*-9*d* but maybe different control instructions from each other as long as those are the control instructions to be controlled simultaneously. For example, the control instructions may be a mixture of an instruction for stopping the transporting roller, an instruction for stopping the paper feeding roller, and the like.

In the step SC3, each of the paper feeing control units 200 needs to identify whether to immediately execute the control instruction transmitted with the unicast mode or to execute the control instruction when receiving the execution instruction transmitted with the broadcast mode.

Therefore, the control instruction that is executed immediately and the control instruction that is executed when receiving the executing instruction transmitted with the broadcast mode are defined with different codes from each other. Each of the paper-feeding side communication control devices 9*a*-9*d* identifies which of the control instructions it has received based on the code of the received control instruction.

Further, parameters may be added to the control instructions so that it is possible to identify whether the control instruction is an instruction that is executed immediately or an instruction that is executed when receiving the executing instruction transmitted with the broadcast mode.

As described above, it is possible with the present invention to prevent damaging the recording paper that is being transported and having a jam of the recording paper within the device caused due to shift in the communication timings, while employing the polling-system communication control for a plurality of paper feeding cassettes.

Another embodiment will be described hereinafter. The above-described embodiment has been described by referring to a case where the communication control devices are provided on the common communication lines connected between the main body control unit and the paper feeding control units for controlling the paper feeding cassettes. However, the communication control device according to the present invention can be applied to a plurality of option units such as a finisher and a sorter which are loaded to the color digital copying machine 1. In particular, it can be applied preferably to a case including controls that need to be executed simultaneously at the plurality of option units.

Image forming device to which the communication control device 9 according to the present invention is applied are not limited only to a tandem-system color digital copying machine but also can be applied to a color digital copying machine, a monochrome copying machine, a printer, and a fax machine, which include a rotary developing device, and to a composite machine to which a plurality of functions of those are mounted, etc.

What is claimed is:

1. A communication control device for controlling communications between a main body control unit and each of a plurality of paper feeding control units by having the main body control unit for controlling an image forming unit connected, via common communication lines, to the plurality of paper feeding control units for individually controlling a plurality of paper feeding cassettes that supply recording papers to the image forming unit, the communication control device comprising:

a unicast mode for transmitting control data individually from the main body control unit to each of the paper feeding control units at different timings;

a broadcast mode for transmitting control data from the main body control unit to each of the paper feeding control units simultaneously; and a communication mode switching part for switching communication modes between the unicast mode and the broadcast mode.

2. The communication control device according to claim 1, wherein the communication mode switching part switches the communication mode from the unicast mode to the broadcast mode at least when stopping the recording paper that is being transported on a paper feeding path from the paper feeding cassette to the image forming unit, or when restarting transportation of the recording paper that is being stopped on the paper feeding path.

3. The communication control device according to claim 1, wherein a control instruction is transmitted to each of the paper feeding control units with the unicast mode, and an executing instruction for the control instruction is transmitted with the broadcast mode.

4. The communication control device according to claim 1, wherein:

with the unicast mode, polling executed to each of the paper feeding control units from the main body control unit is executed according to a connected order of the paper feeding control units that are connected to the common communication lines, and each of the paper feeding control units are to respond to the polling; and with the broadcast mode, polling is executed to each of the paper feeding control units from the main body control unit simultaneously, and the paper feeding control unit that is connected lastly among the paper feeding control units connected to the common communication lines is to respond to the polling.

5. The communication control device according to claim 1, comprising:

a plurality of select signal lines included in the communication lines for designating the paper feeding control units to be a sender unit and a receiver unit; and an encode circuit provided to each of the paper feeding control units, which converts a select signal transmitted via the select signal lines and outputs it to a latter drawer, wherein with the unicast mode, the encode circuit converts individual select signals, which are transmitted from the main body control unit to each of the paper feeding control units via the select signal lines, into a common select signal, and with the broadcast mode, the encode circuit converts the select signals, which are transmitted from the main body control unit to each of the paper feeding control units via the select signal lines, into signals other than the common select signal.

6. An image forming device, comprising a main body control unit for controlling an image forming unit and a plurality of paper feeding control units for individually controlling a plurality of paper feeding cassettes that supply recording papers to the image forming unit, wherein the main body control unit and each of the paper feeding control units are connected via the communication control device according to claim 1.

7. A communication control method for controlling communications between a main body control unit and each of a plurality of paper feeding control units by having the main body control unit for controlling an image forming unit connected, via common communication lines, to the plurality of paper feeding control units for individually controlling a plurality of paper feeding cassettes that supply recording papers to the image forming unit, the communication control method comprising:

a unicast mode transmitting step of transmitting control instructions by using a unicast mode which transmits control data individually from the main body control unit to each of the paper feeding control units at different timings; and a broadcast mode transmitting step of transmitting executing instructions for the control instructions by using a broadcast mode which transmits control data from the main body control unit to each of the paper feeding control units simultaneously.

8. The communication control method according to claim 7, wherein the communication modes are switched at least when stopping the recording paper that is being transported on a paper feeding path from the paper feeding cassette to the image forming unit, or when restarting transportation of the recording paper that is stopped on the paper feeding path.

* * * * *